United States Patent [19]

Horn

[11] Patent Number: 4,882,883

[45] Date of Patent: Nov. 28, 1989

[54] ARCHITECTURAL MODULAR SYSTEM

[75] Inventor: John J. Horn, El Toro, Calif.

[73] Assignee: PBS Building Systems, Inc., Anaheim, Calif.

[21] Appl. No.: 18,916

[22] Filed: Feb. 25, 1987

[51] Int. Cl.[4] ..... E04B 1/34

[52] U.S. Cl. ..... 52/79.1; 52/79.9; 52/143; 52/630; 52/694; 52/814

[58] Field of Search ..... 52/79.1, 79.2, 79.5, 52/79.9, 79.13, 656, 236.3–236.9, 732, 143, 694, 814

[56] References Cited

U.S. PATENT DOCUMENTS

| | | | |
|---|---|---|---|
| 1,995,573 | 3/1935 | Matthews | 52/79.9 |
| 2,061,103 | 11/1936 | Roberts | 52/694 X |
| 2,883,771 | 4/1959 | Kump | 52/79.1 X |
| 3,157,427 | 11/1964 | Reynolds | 52/79.9 X |
| 3,229,431 | 1/1966 | Paul | 52/79.13 |
| 3,481,643 | 12/1969 | Campbell | 52/814 X |
| 3,605,350 | 9/1971 | Bowers | 52/79.9 X |
| 3,738,678 | 6/1973 | King et al. | 52/656 |
| 3,904,380 | 9/1973 | Smith | 52/732 X |
| 4,073,101 | 2/1978 | Yoshida | 52/79.1 |
| 4,644,708 | 2/1987 | Bendot et al. | 52/79.9 |

FOREIGN PATENT DOCUMENTS

| | | | |
|---|---|---|---|
| 2431029 | 1/1975 | Fed. Rep. of Germany | 52/79.1 |
| 2657614 | 7/1977 | Fed. Rep. of Germany | 52/79.1 |
| 76085 | 9/1970 | German Democratic Rep. | 52/79.1 |
| 488878 | 5/1970 | Switzerland | 52/79.1 |

OTHER PUBLICATIONS

Sheffield Steel Joist Catalog No. 452, May 13, 1953, pp. 4 and 29.

*Primary Examiner*—Richard E. Chilcot, Jr.
*Attorney, Agent, or Firm*—George F. Bethel; Patience K. Bethel

[57] ABSTRACT

A modular unit for use in constructing a framework of a building consisting of a plurality of modular units in connected relationship having a floor portion with longitudinal and lateral perimeter members. The longitudinal and lateral perimeter members are joined by joists interconnecting the perimeter members and welded thereto with a corrugated metal decking overlying the joists. The joists are made from a sheet steel configuration which has been bent into a Z shaped configuration with upturned lateral portions. Plywood sheeting overlies the corrugated metal decking. The entire structure incorporates wheel wells for the enplacement of wheels so that the modular unit can be towed into place. Trusses in the roof are support the roof and are attached at the cord sections to upright structural columns. The modular unit are held together by bolts which can be later secured by welding between the perimeter members, the columns, and the truss areas.

5 Claims, 4 Drawing Sheets

ARCHITECTURAL MODULAR SYSTEM

FIELD OF THE INVENTION

The field of this invention lies within the architectural and building art. In particular, it lies in the art of constructing a substantially large structure out of modular units. The modular units can be emplaced in connected relationship with each other after they have been brought to an assembly area whereby they are assembled and lowered into place in adjacent relationship to each other.

THE PRIOR ART

It is believed that the prior art with regard to modular building structures generally incorporate various structures which are emplaced in connected relationship, but none in the manner set forth herein. In the past, the connected relationship has been such wherein the overall structure could not be lowered into place in a ready and facile manner and then bolted in conjunction with each other. Also, in modular structures, the towing and the effective transportation that could be utilized to move the structures into cooperative relationship has been lacking. In particular, such structures have oftentimes been assembled on-site or in other cases, delivered to a particular area in a preassembled form which has not been sufficiently formed to provide for facile and ready assembly and incorporation into an entire building structure.

This particular invention incorporates features which allow for ready and facile movement of the entire modular units into adjacent and close associated relationship without the requirement of detailed assembly at the site or other related structural problems having to be resolved at the site.

The invention incorporates the aspects of using lightweight cross members incorporating a metal pan. The metal pan is corrugated or ribbed to provide for strength, as well as overall damping of the structure. The corrugated or ribbed pan configuration allows for a placement of sheet material thereover to form a sub floor. The sheet material can be in the form of plywood that is employed in a tongue and groove relationship.

The assembled modular structures are held together by means of tie plates as well as bolts in a novel manner. For this reason, it is believed that the invention is novel over that of the prior art with regard to both the modular units themselves and the combined units when formed as an assembled building.

Another element of significance insofar as the inventive aspects of this invention is concerned, relate to the lifting rods. The lifting rods pass through the entire structure and enable a structure to be placed from the top by means of a crane or other hoisting means. After the modules are emplaced, the lifting rods can be readily removed and the units tied together by means of the tying plates.

As will be seen in the following specification, this invention is a substantial step over the prior art and provides for the improved assembly of modular architectural units over that of the prior art.

SUMMARY OF THE INVENTION

In summation, this invention comprises a series of structural modular units which can be incorporated into a side by side and end to end relationship, with improved sub-floors, overhead truss relationship and securement of the modular units after they have been emplaced by means of a support rod.

More particularly, the invention incorporates the features of a boxlike series of modular units that are formed with frame members having a base, a pan member overlying the base structure, as well as subflooring. The overhead configuration incorporates trusses and end columns that are utilized to hold the trusses and the entire unit in place as far as static loading is concerned.

The units are emplaced in stacked relationship by means of emplacement hoisting rods which extend from the base of the unit through the modular units up through the tops so that lifting of the entire units can take place in a simplified manner without stretching and straining the structure.

The subfloor incorporates a series of metal sheets which are corrugated or ribbed so that they provide structural strength as well as dampening. On top of the corrugated sheet, a flat layer of material such as plywood is emplaced to provide for rigidity and structural integrity.

The modular units are held together by means of bolts and tying members. These bolts and tying members are such where they incorporate openings that are tied to plates to receive bolts between one modular unit and the other to hold them in situ after they have been lowered in place by the support rods.

DESCRIPTION OF THE DRAWING FIGURES

The invention will be more clearly understood by reference to the description below taken in conjunction with the accompanying drawings wherein.

DESCRIPTION OF THE PREFERRED EMBODIMENTS

Figure 1:
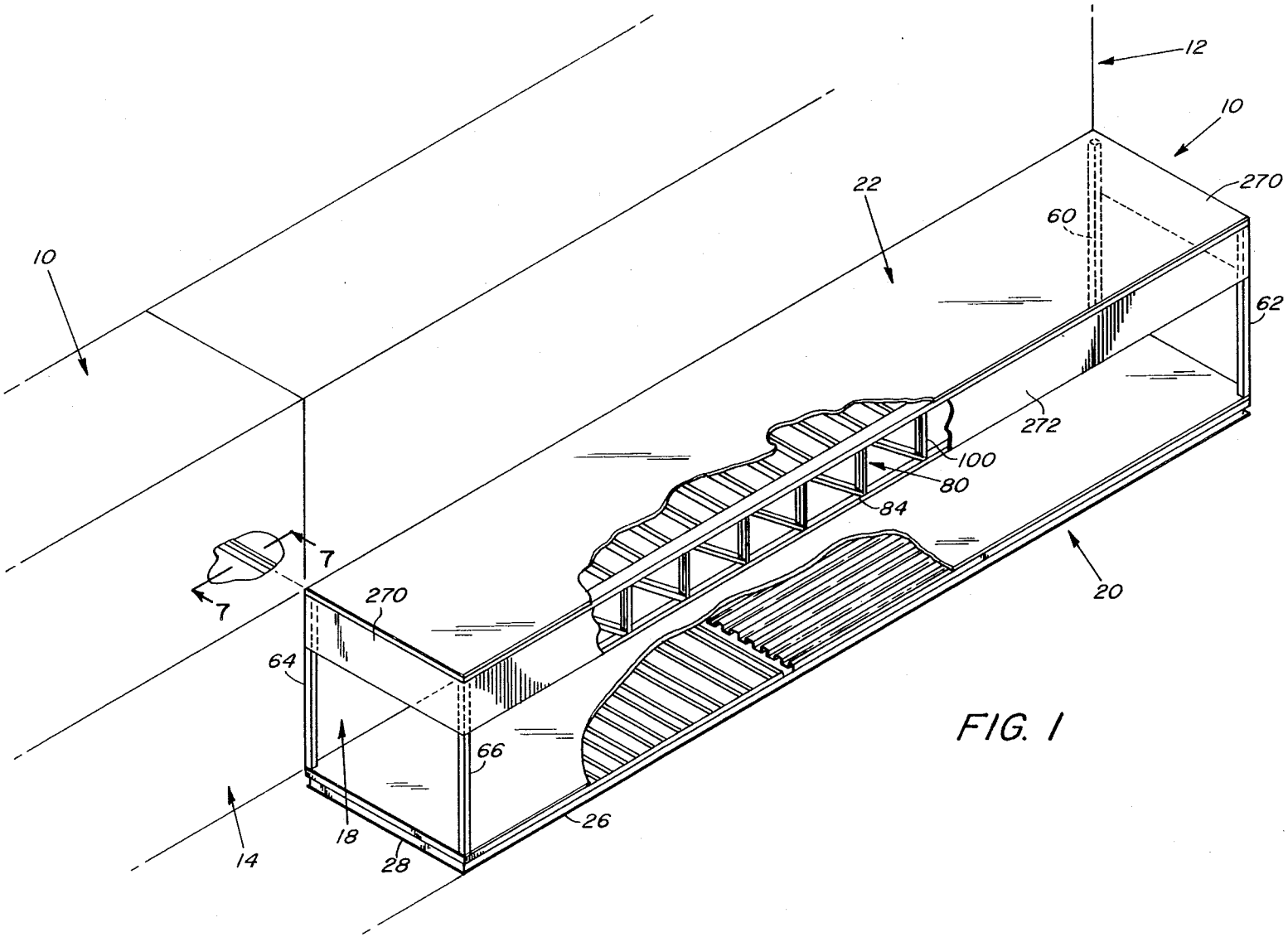
FIG. 1 shows a perspective view of one of the modular units that has been fragmented to show the upper truss members and the flooring.

Looking at FIG. 1, it can be seen wherein a plurality of modular units 10, 12, 14, 16 and 18 underlying unit 12 are shown. The respective units are modular units that are built off site and then lifted to provide an assemblage in the form of a building.

The factory assembly is to be expanded upon hereinafter to describe each particular modular unit in its separate configuration.

In order to appreciate the respective units in the overall configuration, it should be understood that each unit has a floor structure 20 and a roof structure 22. The floor structure 20 has been detailed in FIGS. 2 and 3 and some of the ancillary figures, such as FIGS. 5, 6, 7, 8 and 10.

Figure 2:
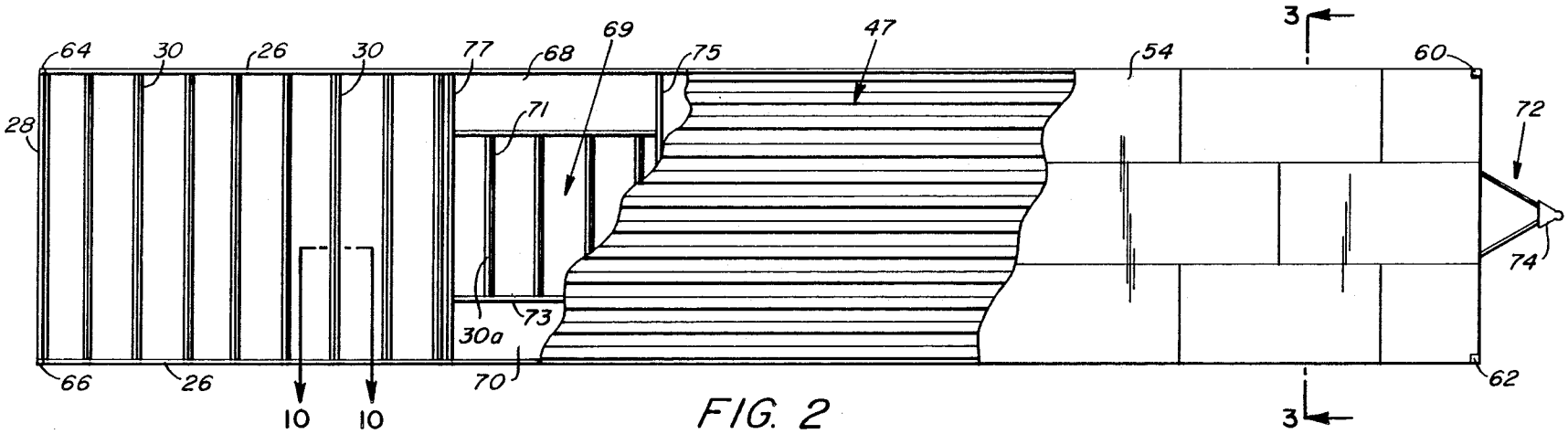
FIG. 2 shows a fragmented plan view of the flooring as generally seen in a downward view looking at the perspective view of FIG. 1.

The floor structure looking downwardly on the plan view of the floor structure, can be seen in FIG. 2. In FIG. 2, it is seen wherein an eight inch perimeter channel 26 has been shown. The eight inch perimeter channel circumscribes the entire periphery of the floor area on either side and can terminate in either a floor joist or channel 28 at either end.

Between the respective perimeter channels 26, a plurality of Z shaped floor joists 30 are welded. The Z shaped floor joists are generally configured in a manner whereby they can be rolled from sheet stock to form the joists. The detail of the Z shaped floor joists 30 has been shown in FIG. 10. Each Z shaped floor joist as can be seen has a rolled configuration with two lateral portions of the Z, namely, 34 and 36 which are upturned respectively at points 38 and 40. In between the lateral portions is a vertical portion 44.

The utilization of the rolled Z shaped joists enables strong structural members to be applied to the structure without the requirement of having rolled or specifically cast joist configurations such as an I beam or related structural members that are known in the art. The Z shaped joists 30 can be configured by a metal brake which bends the Z into the configuration generally shown in FIG. 10.

The floor joists 30 are overlaid with a metal corrugated decking 42. The metal corrugated decking 42 is particularly capable of being used in this application due to its resiliency and strength in the manner in which it is laid across the joists 30 and welded thereto. The laying of the decking across the joists and the welding provides for a rigidified structure. To date, it is not known wherein this type of corrugated decking 42 is utilized in any manner other than for use with metal building structures wherein the decking has concrete poured into the grooves thereof. In such applications the raised portions (i.e. the lands), received concrete thereover which is screeded down to the level thereof and into the grooves or channels of the corrugated decking 42. Such corrugated decking is not known to be used in any particular utilization such as the Applicant has used herein.

Figure 7:
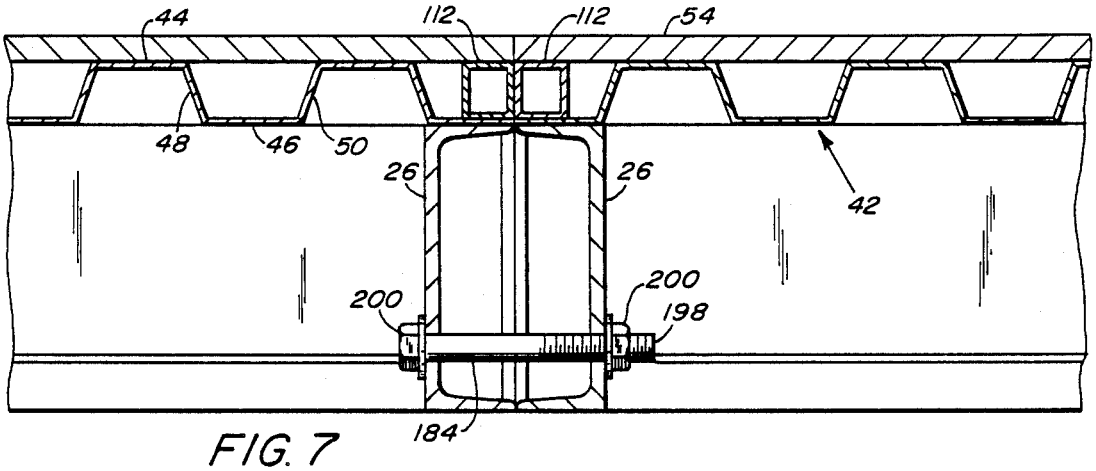
FIG. 7 shows a sectional view of the modular units as tied together in a manner to provide for securement of the units in adjacent relationship.

Looking more particularly at the corrugated decking in FIG. 7, it can be seen wherein it comprises lands 44 and grooves or channels 46. The lands 44 and grooves 46 are formed with angular lateral side walls 48 and 50. The angular lateral side walls 48 and 50 provide for the respective upright rigidifying portions of the corrugated decking. The channel base portion or groove 46 walls have been welded to the joists 30.

Underlying the decking 42 can be insulation to provide for sound insulation and to deaden the respective noise of people walking on the decking. This is enhanced by means of attaching the underlying sound deadening material to the decking and incorporating it therein at the factory for maintenance of sound deadening.

The insulation can be provided under the decking 42 in any suitable manner such as by staples, glueing, screws or other means. Furthermore, the insulation can be of any particular type known in the art, including a board type insulation or sound deadening composite wool materials that have been densified.

On top of the decking 42 three quarter inch tongue and groove plywood sheets are fastened to the deck. In particular, plywood sheets 54 are shown attached to the decking. The plywood sheets 54 are tongue and groove and are mated to each other respectively in the configuration as seen in FIG. 2 in the manner in which they are laid down on top of the decking 42. This plywood floor is the underlying floor upon which the finished floor in the form of carpet, tile, sheet vinyl or finished wood flooring can be applied.

The entire floor, except for the finished carpet, is installed in a factory prior to delivery to the site and erection on the site. Thus, the entire module can be prepared and driven to the site and later held in place in the manner to be described to form a building.

Looking more particularly at the plan view of FIG. 2, it can be seen wherein corner posts 60, 62, 64 and 66 are shown. The corner posts 60 through 66 support the modules in their stacked relationship.

The plan view shows two openings 68 and 70. The two openings 68 and 70 are such wherein they provide wheel wells for receiving wheels with an underlying axle passing under the modular unit. Inasmuch as the modular units are towed into place, the wheel wells 68 and 70 are necessary for towing purposes but of course are decked over at the factory and only provide for the wheels being emplaced therein during moving. The wheels can be attached to an axle which can be either permanently secured to the structure or preferably removable after it is towed in place.

The wheel wells 68 and 70 have a mid joist area 69 provided by longitudinal structural members 71 and 73. The structural members 71 and 73 are joined to laterals 75 and 77. The foregoing provides support for diminished joists **30*a* for supporting the decking 42 thereover and over the wheel wells 68 and 70**.

A trailer hitch 72 is shown having two angular members with a trailer coupling 74. The trailer coupling 74 allows the hitch 72 to be attached to a trailer for towing of the modular units 10 through 18 into location. After which, the trailer hitch 72 is removed to provide for erection and matched abuttment of the respective units 10 through 18.

Looking at the roof design, it can be seen wherein a span of structurally designed steel trusses 80 are shown in a manner whereby they span the structure. The detailed configuration of the trusses can be seen clearly in FIG. 9. The trusses 80 seen in FIG. 9 are attached to the columns 60 and 62 at either end, as well as 64 and 66, by being welded to the top and bottom cords of the truss.

In particular, cords 84 and 86 are shown made of angle brackets 88 and 90 respectively for cord 84 and 92 and 94 for cord 86. The respective cords 84 and 86 are secured and welded to angular truss members 100 and 102. These angular truss members 100 and 102 are welded in a manner so that they encompass the cords 84 and 86 therebetween. As can be seen, the angular members 100 and 102 have a space 106 therebetween which allows the upright of the cord angle members 88 and 90 to be received therein. The foregoing structure provides a significantly strong truss for supporting the roof and an underlying floor in its stacked relationship.

Figure 9:
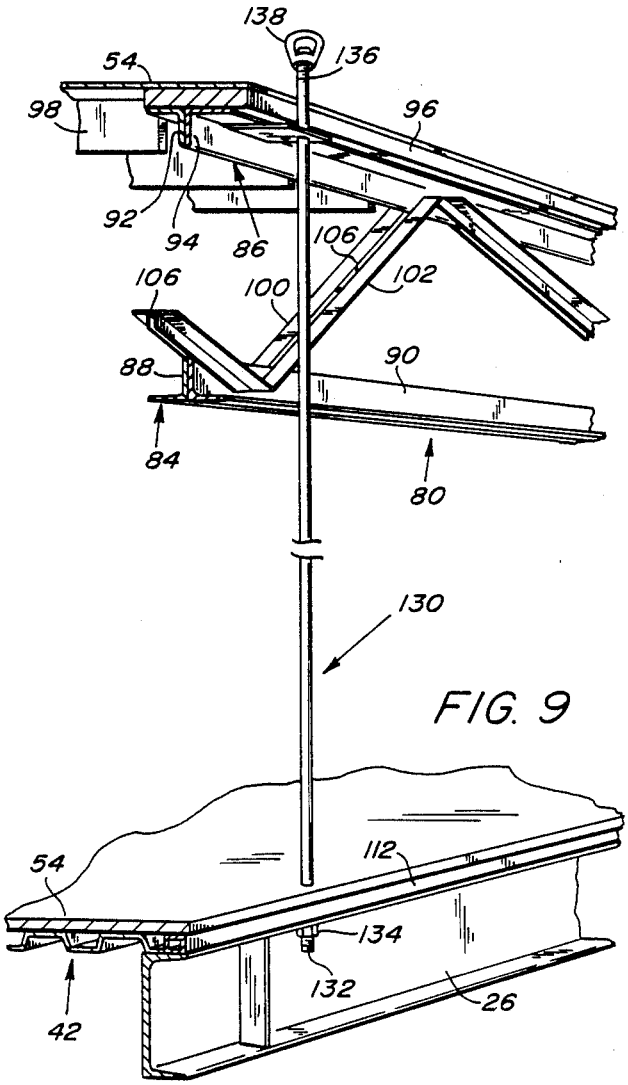
FIG. 9 shows a fragmented perspective view of the lifting rod assembly for placing the units in side by side relationship.
Figure 10:
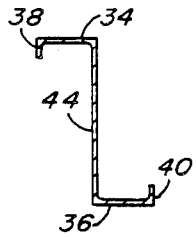
FIG. 10 shows a section through a typical floor joist.

Looking more particularly at the upper portion of FIG. 9 on the top of the truss, it can be seen wherein the top of the truss has a plate 96 which can be a wooden or metal plate, depending upon usage, and a plurality of rafters 98 with a roof deck overlying the rafters 98. The roof deck can be in the form of plywood 54 which is equivalent to a decking member or it can be of any other type of material such as metal sheet to cover the rafters 98. Also, the rafters 98 can be substituted by way of the Z members shown in FIG. 10. In particular, the Z shaped joists 30 can be utilized for the upper members as a substitute for the rafters 98, depending upon the particular usage.

The units 10 through 18 are emplaced in adjacent relationship to each other and held in situ by welding or bolting bolts to interconnect them.

In order to provide a configured modular member to mate with an adjacent member, it is necessary to have uniform ends terminating in different locations.

Figure 3:
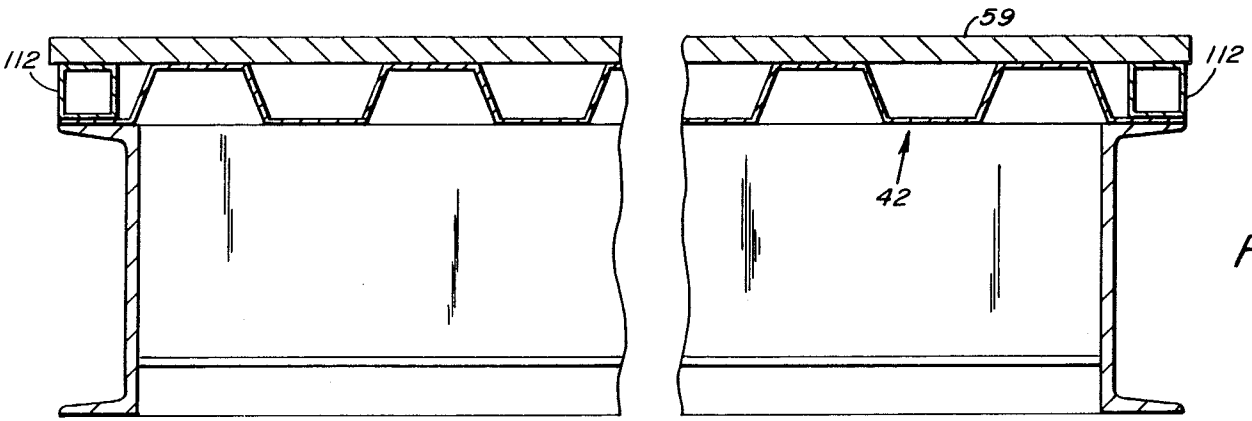
FIG. 3 shows a fragmented sectional view of the subflooring and base structural members seen in the direction of lines 3—3 of FIG. 2.

Looking particularly at FIG. 3, it can be seen wherein the decking 42 or corrugated sheets terminate with a rectangular channel member 112 at either side and at the ends. The rectangular channel member 112 allows a spacing between the plywood deck 54 and the underlying groove portion 46 of the corrugated decking 42.

The respective units 10 through 18 are held in place by side by side attachment. This is accomplished after the units are lowered into place and when the undercarriage and trailer hitch has been removed. In order to emplace the units, a vertical emplacement rod 130 is shown passing through the periphery of the perimeter channel 26. The vertical hoisting rod passes through the perimeter channel 26 and is secured at a threaded end 132 thereof by means of a nut 134.

The vertical hoisting rod 130 is connected at the other end by means of a threaded end 136 to an eyelet 138 which can receive a hook, wire, or other hoist means to lift the modules 10 through 18 into place. The respective hoisting rods 130 can be emplaced at various locations through the peripheral channels 26. Preferably, they are emplaced in a manner so that for example four are located in balanced locations so that they can be attached to a wire cradle to provide a hoist wire to the four rods for lifting of the entire modular unit.

Once the modular units 10 through 18 are in place, they are secured by means of the channel members 26 being placed into abutting relationship and bolted to each other. For example, in FIGS. 5 and 6 it can be seen where the bottom unit underlying structures are held together by means of the channel members which are abutting channel members 26 having L shaped tabs 160 and 162 that have depending portions 164 and 166.

The depending portions 164 and 166 are provided with a slotted opening 168 that receives a bolt 170 having a head 172 thereon which on the other end receives a nut 176. Washers can be used to back up the head 174 and nut 176, or any other configuration can be used to hold the channel members 26 in adjacent relationship. This serves to accommodate the side by side mating and retention of the units 10 through 18 in place. The units can also be secured thereafter by means of welding them so that they are held in rigid juxtaposition by not only the bolt 170 but also the welding of the modular units 10 through 18 together.

Figure 8:
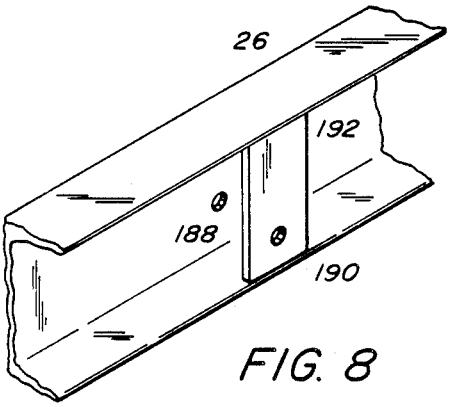
FIG. 8 shows a perspective view of the channel members that are being tied together as shown in FIG. 7 without a bolt passing through the openings thereof.

Looking more particularly at FIGS. 7 and 8, it can be seen wherein the units are held together in an alternative manner. The channel members 76 are secured by a bolt 184 passing all the way through holes in the channel member, namely holes 188 in the outer portion thereof and a hole 190 passing through a plate 192 thereof.

The bolt 184 has a threaded end 198 with a nut 200 thereover and a head 202 at the other end. Washers are utilized in order to secure the bolt 184 in fixed position and allow a turning and proper alignment of the bolt 184. Thus, the foregoing units can be secured with the configuration shown in FIGS. 7 and 8, as well as that of FIGS. 5 and 6.

Figure 4:
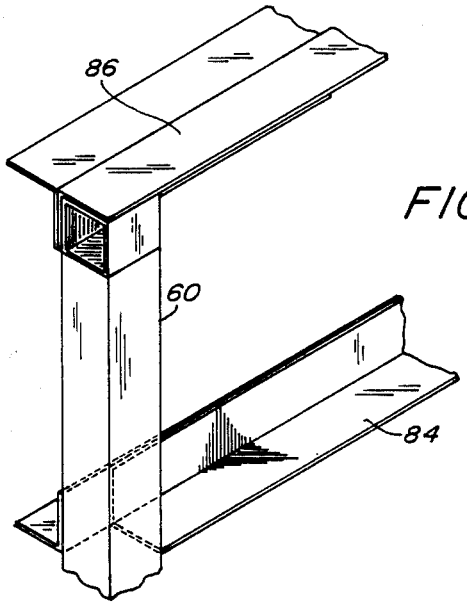
FIG. 4 shows a fragmented perspective view of the columns that support the top of the modular unit.
Figure 5:
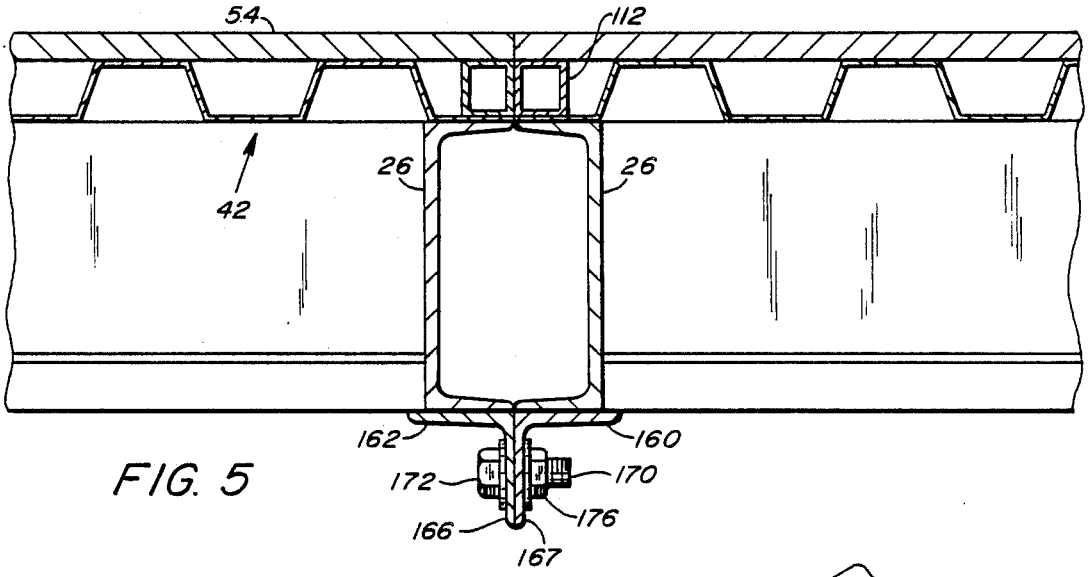
FIG. 5 shows a sectional fragmented view of the modular unit floor structures as they are tied together by means of a bolt and plate for tying channel members of first floor units together.
Figure 6:
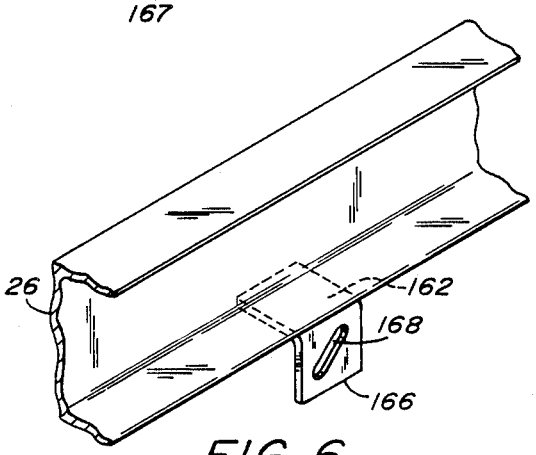
FIG. 6 shows a sectional view of the tie plates which are in the form of an L to tie the respective modular units together.

The top of the trusses, as seen in FIG. 4, namely the cords 86, terminate at the end posts, namely posts 60 through 66. The termination thereof and the abuttment is held in secured relationship by means of a column tie plate between columns. The column tie plates are such where they can be utilized along the length of the column to hold the respective columns 60 through 64 in place. The tie plates can be welded, bolted, or secured in any other manner in order to hold the respective columns together. Thus, the matrix of the units 10 through 18 are rigidified not only along the roof sections and the lower sections, but also by the end column plate configuration.

An assembly of the modules in a three story configuration is such wherein the modules are welded together to produce a three story building. This is accomplished by using progressively smaller exterior and interior thickness of columns from the lowest floor to the top floor. Columns 60 through 66 vary in thickness and strength depending upon the required elements. Thus, the lowest floor of a three story building would have to have thicker columns 60 through 66 than the lowest floor of a two story modular construction.

The structure shown in FIG. 1, namely modular unit 10, shows a covering completely around the exterior portion, namely a covering 270 is shown at either end and an intermediate covering 272 along the length thereof. This covering is for outer units. However, an interior unit does not require the cover. Thus, a center unit would have no covering. In effect, the center units have a roof covering and a floor covering, but no vertical covering, as shown, namely covering 270 and 272 at the respective ends and along the longitudinal section.

A left plan view unit would have a covering on two sides and a right plan view unit would have a covering on two sides. They would have a module in between them, which would not require a covering therebetween. Thus, depending upon the respective orientation and placement of the units 10 through 18, the coverings 270 and 272 along the sides would not be utilized except for those exterior portions. The windows, sides or other portions of the siding which is emplaced between the floor and ceiling space of the module would be received in the area below the covering on the exterior portions. On the interior portions, a continuity of ceiling underlying the trusses would be applied. The underlying area of the trusses would be spanned by a ceiling which can be in the form of ceiling tiles, wall boards, plastic, or any other suitable interior cover. It should be understood that the configuration shown herein has the structural features of the modular unit and not the finished features, including those outside areas such as windows and doors which would be emplaced within the spaces, for instance between the side covering 270 and 272 and the floor 54 provided by the plywood.

The modules produce a building of any particular configuration. The configuration is accessible by elevator, interior stairways, or exterior stairways, depending upon the desire of the end user. Thus, the optional capability of providing whatever access to the building after the modular structure is assembled, is at the option of the end user.

From the foregoing, it can be seen wherein the invention provides a significant improvement over the prior art by having pre-assembled modular units to provide strong rigid structures in a multitude of configurations, depending upon the particular end user and the size desired, both as to numbers of floors and square footage of each respective floor. Thus, the foregoing should be read broadly in light of the following claims as to being a significant advance over the prior art of building structures.

I claim:

1. A building formed of a plurality of modular structures wherein each of said modular structures comprises:

a base floor region a perimeter channel member in said base floor region of said structure;

joists between said perimeter channel member;

a metal corrugated decking secured to said joists;

upright columns extending from said perimeter channel member;

truss members having cords extending between said upright column members and wherein the cords of said truss members are secured to said column members;

said cords of said truss members having an upper and lower cord portion;

bracing members in the form of rafters extending between said trusses;

plywood sheeting overlying said corrugated decking;

diagonally oriented angle members extending between said cords of said trusses and secured thereto;

a plurality of modular structures joined together by securement means extending between said perimeter channel members; and, plates between said columns in the form of column tie plates for securing one column of a modular structure to a second column of an adjacent modular structure.

2. The building as claimed in claim 1 further comprising:

rectangular channel members overlying said perimeter channel member; and, plywood floor sheets attached to said metal corrugated decking and overlying said rectangular channel members.

3. The building as claimed in claim 1 further comprising:

wheel wells within said joist region and interiorly of said perimeter channel members for receiving wheels to transport said modular structures prior to assembly into said building.

4. The building as claimed in claim 3 further comprising:

side wall cover portions covering and overlying said truss members at the portion of said modular structures which are exposed to the outer portion of said building.

5. The building as claimed in claim 4 wherein:

said joists comprise metal sheets formed as Z shaped members and wherein said terminal portions of said Z shaped members turn inwardly to form a rigidified structural member.

* * * * *